US009102157B2

(12) United States Patent
Prothon et al.

(10) Patent No.: US 9,102,157 B2
(45) Date of Patent: Aug. 11, 2015

(54) MEASURING SYSTEM IN A FLUID CIRCUIT OF A CONTINUOUS INKJET PRINTER, RELATED FLUID CIRCUIT AND BLOCK DESIGNED TO IMPLEMENT SAID MEASURING SYSTEM

(75) Inventors: Florent Prothon, Montvendre (FR); Francis Pourtier, Charmes sur Rhone (FR); Sébastien Pouzet, Saint Fourtunat sur Eyrieux (FR)

(73) Assignee: MARKEM-IMAJE HOLDING, Bourg-les-Valence (FR)

( * ) Notice: Subject to any disclaimer, the term of this patent is extended or adjusted under 35 U.S.C. 154(b) by 186 days.

(21) Appl. No.: 13/518,800

(22) PCT Filed: Dec. 21, 2010

(86) PCT No.: PCT/EP2010/070416

§ 371 (c)(1),
(2), (4) Date: Aug. 8, 2012

(87) PCT Pub. No.: WO2011/076810

PCT Pub. Date: Jun. 30, 2011

(65) Prior Publication Data

US 2012/0299989 A1 Nov. 29, 2012

Related U.S. Application Data

(60) Provisional application No. 61/301,723, filed on Feb. 5, 2010.

(30) Foreign Application Priority Data

Dec. 23, 2009 (FR) ..... 09 59504

(51) Int. Cl.
*B41J 29/38* (2006.01)
*B41J 2/175* (2006.01)

(52) U.S. Cl.
CPC ..... *B41J 2/175* (2013.01); *B41J 2/17566* (2013.01); *B41J 2/17596* (2013.01)

(58) Field of Classification Search
CPC ..... B41J 2/17566; B41J 2/17569; B41J 2/17589; B41J 2/04571
USPC ..... 347/5–7, 84–86
See application file for complete search history.

(56) References Cited

U.S. PATENT DOCUMENTS 4,432,005 A * 2/1984 Duffield et al. ..... 347/86
4,827,278 A 5/1989 Lecheheb (Continued)

FOREIGN PATENT DOCUMENTS

CN 1201142 (A) 12/1998
CN 1235904 (A) 11/1999

(Continued)

OTHER PUBLICATIONS

International Search Report issued Mar. 15, 2011, in International Application No. PCT/EP2010/070416.

(Continued)

*Primary Examiner* — Stephen Meier
*Assistant Examiner* — Sharon A Polk
(74) *Attorney, Agent, or Firm* — Miles & Stockbridge P.C.

(57) ABSTRACT

The invention concerns a measuring system in a fluid circuit of a continuous inkjet printer. According to the invention, a system for measuring the quantity of ink is realized using a continuous sensor (15) equipping a measuring tank (12), which is first emptied then connected by communicating vessel with an intermediate tank (11) storing the ink which, pressurized, supplies the printing head and The measuring system advantageously constitutes a multifunctional system since it makes it possible, using a dedicated constant level tank (13) communicating with the intermediate tank (11) and also by communicating vessel with the measuring tank (12), to measure the viscosity of the ink and the correction thereof if necessary by adding solvent from a dedicated solvent tank (14).

25 Claims, 5 Drawing Sheets

(56) References Cited

U.S. PATENT DOCUMENTS

| | | | | |
|---|---|---|---|---|
| 4,862,192 | A | 8/1989 | Slomianny | |
| 5,160,939 | A | 11/1992 | Bajeux et al. | |
| 6,082,851 | A * | 7/2000 | Shihoh et al. | 347/85 |
| 6,151,039 | A | 11/2000 | Hmelar et al. | |
| 6,352,324 | B1 | 3/2002 | Pagnon et al. | |
| 6,793,305 | B2 | 9/2004 | Tsukada et al. | |
| 7,013,804 | B2 | 3/2006 | Chelvayohan | |
| 2003/0071862 | A1 | 4/2003 | Tsukada et al. | |
| 2005/0128230 | A1 | 6/2005 | Chelvayohan | |
| 2006/0290723 | A1 | 12/2006 | Jeong | |
| 2008/0100660 | A1 | 5/2008 | Perrin et al. | |

FOREIGN PATENT DOCUMENTS

| | | | |
|---|---|---|---|
| CN | 1380852 (A) | | 11/2002 |
| CN | 1883952 (A) | | 12/2006 |
| CN | 101253047 (A) | | 8/2008 |
| CN | 101437686 (A) | | 5/2009 |
| DE | 1816856 | A1 | 7/1970 |
| EP | 0 362 101 | B1 | 11/1993 |
| EP | 0 882 595 | A2 | 12/1998 |
| EP | 0 916 502 (A2) | | 5/1999 |
| EP | 1 285 764 | A1 | 2/2003 |
| EP | 0 968 831 | B1 | 6/2003 |
| FR | 2879961 | A1 | 6/2006 |
| JP | 2001-071532 | A | 3/2001 |
| WO | WO 88/04235 | | 6/1988 |
| WO | WO 2007/129110 | A2 | 11/2007 |
| WO | WO 2009/047497 | A2 | 4/2009 |

OTHER PUBLICATIONS

International Search Report issued Mar. 16, 2011, in International Application No. PCT/EP2010/070413.

Chinese Office Action issued May 4, 2014, in Chinese Application No. 2010800646875 with English Translation.

Chinese Office Action issued Apr. 28, 2014, in Chinese Application No. 2010800636144 with English Translation.

* cited by examiner

MEASURING SYSTEM IN A FLUID CIRCUIT OF A CONTINUOUS INKJET PRINTER, RELATED FLUID CIRCUIT AND BLOCK DESIGNED TO IMPLEMENT SAID MEASURING SYSTEM

CROSS-REFERENCE TO RELATED APPLICATIONS

This application is a U.S. national stage entry of International Application No. PCT/EP2010/070416 filed Dec. 21, 2010, which claims the benefit of U.S. Provisional Application No. 61/301,723 filed Feb. 5, 2010, and French Application No. 09 59504 filed Dec. 23, 2009, all of which are incorporated by reference herein in their entirety.

TECHNICAL FIELD

The invention concerns a measuring system in a fluid circuit in a continuous inkjet printer and more particularly a system making it possible to measure the quantity of ink and the viscosity of the ink as well as to correct this viscosity.

It also concerns a fluid circuit of an inkjet printer, implementing such a measuring system which completes the two "basic" functions of the circuit, i.e. supplying the printing head with pressurized ink and recovering fluids returning from the head by suction.

BACKGROUND OF THE INVENTION

Continuous inkjet printers are well known in the field of coding and industrial marking of various products, for example to mark barcodes or the expiration date on food products directly on the production chain and at high speed rate. This type of printer is also found in certain decorative fields where the graphic printing possibilities of the technology are exploited.

It is traditionally distinguished two categories within continuous inkjet printers:

- on one hand, multi-deflection continuous jet printers where each drop of a single jet (or few jets) can be sent on various paths corresponding to controls for different deflections of the drops, thereby achieving a raster stroke that prints a column of dots on the zone to be printed, in a direction which is the deflection direction;
- on the other hand, binary continuous jet printers where a plurality of jets placed side by side each have only one path designed for printing; the synchronous control, at a given moment, of all of the jets makes it possible to print on the medium according to a pattern corresponding in general to that of the nozzles on the nozzle plate.

In both types of printers, the printing of a surface is achieved by the relative movement between the printing head and the medium to be printed.

As illustrated in FIG. 1, these printers include a printing head 1, generally distant from the body of the printer; it is connected thereto by an umbilical 19 bringing the hydraulic and electrical connections necessary for the operation of the head.

The head 1 has a drop generator 2 supplied with pressurized electrically conductive ink and capable of emitting one or several continuous jets 9 through nozzles, the jets being transformed into a succession of drops under the action of a periodic stimulation system situated upstream from the nozzle(s). When the drops are not intended for printing, they are directed toward a gutter 3 which recovers them in order to be recycled. Devices 4 placed along the jet (charge and deflection electrodes) make it possible, upon command, to electrically charge and deflect the drops; these drops are deviated from their natural ejection trajectory from the drop generator. The drops intended for printing escape the gutter and are deposited on the medium to be printed (not shown).

Inkjet printers also comprise a fluid circuit which performs the two basic functions, i.e. providing ink to the drop generator at a suitable pressure and with a suitable quality, and recovering, by suction, the ink not used for printing from the jets.

Inkjet printers also comprise a controller capable of managing the action sequencings (sensor output measurements, active component controls . . . ) and performing the processing enabling the activation of the different functions.

These printers lastly comprise an interface which gives the operator a means to run the printer and in return to be informed of the operation thereof.

The general opinion is that the reliable operation of an inkjet printer requires the completion of periodic maintenance interventions.

Some are manual, such as resupplying the printer with consumables (ink and solvent) to replace the consumed fluids: it is then useful, or even imperative for the printer to notify the user of the exhaustion of reserves. In this category we can also cite the changing of life-limited components or wearing parts, such as the filters or mobile pump elements through preventive maintenance. Other maintenance operations have every interest in being automatic for reasons of frequency, accessibility of the components and reliability (by repetitiveness) of execution.

The operating functions of the head are in this last category. These functions concern the jet stops and starts, the cleaning or rinsing of the drop generator, the nozzle and the gutter, and the stability checking of the jet; they contribute greatly to the overall reliability of the printer. This is why many existing printing heads are provided with hydraulic switching elements (solenoid or one-way valves) making it possible to connect the drop generator to the pressurized ink source and to a solvent source, as well as to a vacuum source. Likewise, the ink recovery gutter can be provided with a closing element, and potentially with a supply of solvent. The command sequencing for these hydraulic elements makes it possible to perform jet stops and starts optimally.

This type of arrangement is for example described in patent applications JP2001071532 by Keyence and FR 2879961A1 by the applicant.

The functions performed by a continuous inkjet printer fluid circuit according to the prior art can be broken down into two categories:

- the functions, which can be called "basic", of which there are two, which consist of providing ink at a regulated pressure to the drop generator of the head and recovering, by suction, the fluids not used for printing returning from the head,
- the functions, which can be called "utility" functions, which are related mainly to the supply of consumables (ink and solvent), monitoring and control of the ink quality, maintenance of the head.

These two types of functions have very different purposes and technical requirements. They are activated and sequenced by the controller of the printer.

Basic Functions of the Fluid Circuit:

In the prior art, we find different ways of performing the basic functions of a fluid circuit for continuous inkjet printer. The pressurization of the ink is generally done either by using pumps, which can be of various technologies, or by pressurization of a tank using compressed air in which the ink has been transferred. The vacuum or suction is generally generated either by the direct use of a pump or a hydro-ejector powered by a flow of pressurized ink, or by a tank depressurized using, for example, a venturi supplied with compressed air.

Among all of the solutions available in the prior art, there is one particularly simple, reliable and proven solution: the ink is pressurized using a gear pump (proven technology used by a large number of manufacturers of this type of printer) for example driven by a motor (direct current or step-by-step) whereof the controller can control the speed of rotation. The ink thus pressurized passes through an anti-pulsation system making it possible to damp the pressure undulations generated by the gears. This solution is for example used in the printers marketed in the name of the company Markem-Imaje under the product name 9040. The pressure of the ink is measured using a pressure sensor before being filtered by the main filter and directed toward the printing head. The pressure value measured by said sensor can be used by the controller to control the ink pressure at a given set point by acting on the speed of rotation of the motor. A second control mode is generally implemented when the jet speed is available (measured at the head), the controller can then act on the speed of the pump motor to control the speed of the jet at a given value, the pressure sensor is then used as indicator for monitoring of the machine. In general, the temperature of the ink is also measured at the outlet of the pump in order to take it into account in the different control functions of the printer.

Since the gear pumps generally have a flow much greater than the flow required for the ejection of an ink jet, it has already been proposed in the prior art, for example in U.S. Pat. No. 4,827,278 by Domino Printing Science PLC, to use this driving power in a hydro-ejector (venturi) in order to perform the second basic function, i.e. the suction necessary for the return of fluids coming from the head.

Utility Functions of a Fluid Circuit:

In order to supply the printing head with ink, most ink circuits for continuous jet printers of the prior art use at least one tank which can be described as intermediate.

Indeed, in this intermediate tank the ink of suitable quality, i.e. ink with a suitable viscosity and/or concentration, is prepared, and then supplied under pressure to the printing head. Moreover, the fluids (related ink and solvent) not used for printing returning from the head are recovered in this intermediate tank. The ink used for printing must be replaced in the intermediate tank from, in general, an external reserve (cartridge or can) provided by the user (operator) of the printer.

As previously stated, the pressurized ink which supplies the head for printing purposes must be of suitable quality. Indeed, because the solvent evaporates during the recycling of the unprinted ink, the viscosity and/or concentration of the ink must generally be adjusted periodically by adding solvent in the intermediate tank, in general from an external reserve (cartridge or can) of solvent provided by the user of the printer.

Thus, a first utility function consists of determining the quantity of ink. In the prior art, this involves detecting characteristic levels of ink in this intermediate tank. Given the expected characteristics of the fluid circuit in general, it is only necessary to detect two or three discrete levels in this intermediate tank: a high level to make it possible to avoid overflowing, a working level which the controller will try to maintain by adding new ink, and a low level to make it possible to avoid ingestion of air by the ink pressurization system. In certain cases, only the high and low levels are exploited.

Many discrete level detector technologies have been used in the prior art, one of the most reliable and easiest to implement uses the principle of rod level sensors dipping into the tank; this principle takes into account the fact that the liquid to be detected is conductive. The resistivity is measured between two rod level sensors dipped into the tank, and if the ink short circuits the rods, the drop in resistivity is detected to declare a presence of ink at that level. This system remains, however, costly due to the electronic protections which the standards require be implemented when electrical currents pass in flammable environments, which is in general the case of ink with volatile solvent. Furthermore, this type of detector cannot be used with insulating fluids as solvents generally are.

A second utility function is the viscosity measurement. In the prior art, the viscosity is often measured by determining the time necessary for the flow of a given quantity of fluid through a calibrated hydraulic restrictor. This device generally requires the implementation of dedicated means: a measuring cavity, at least two level detectors, hydraulic switching means to fill and empty the cavity.

Quasi-identical means are necessary to implement a rolling ball viscosity meter which is also found in the prior art (for example as shown in application WO 2007/129110). In this type of viscosity meter, the lowering speed of a ball in a vertical tube having an internal diameter slightly larger than the diameter of the ball is representative of the viscosity of the fluid contained in the tube. These devices require the implementation of a significant number of components. The evaluation of the viscosity can also be done without viscosity meter, in a continuous inkjet printer, by measuring the parameters of the jet when it is operational, and its speed, when possible. Indeed, one can identify, for a given situation (ink and nozzle in particular), a characteristic connecting the viscosity of the ink passing through the nozzle to the speed of the jet, for a measured ink pressure upstream from the nozzle and for a measured ink temperature (patent by Company Imaje EP 0 362 101 B1). This method does not provide all of the desired flexibility in all situations, in particular due to the need to have an operational ink jet, i.e. effectively ejected by the head at a speed close to the nominal speed, to perform the measurement.

A third utility function consists of correcting the viscosity (or concentration) of the ink contained in the intermediate tank. The major drawback of the solutions used by the prior art is that the quantity of solvent making it possible to correct a viscosity gap of the volume of ink contained in the intermediate tank can only be crudely evaluated since, on one hand, the concerned volume of ink is not precisely known, and on the other hand the volume of solvent added is also not precisely known. This is due to the fact that the means used do not allow it (time for passage of a poorly-defined flow of solvent through a distribution member: solenoid valve or pump). An approximate control of the viscosity in relation to the expected viscosity is of little consequence when robust inks are used but limits the possibilities for using the printer with sensitive inks.

Other utility functions are useful in order to decrease the risks of hazardous manipulations or to increase user comfort.

For example, it is interesting to evaluate the quantity of consumable available in the replacement reserves of consumed fluids. According to the prior art, solutions can consist of transferring cans (bottles) of consumable product into auxiliary tanks integrated into the fluid circuit. These tanks are provided with a level detector (Series S8 printer marketed by the company Imaje).

One can also use sealed and removable consumable cartridges which are tightly connected to the fluid circuit as needed. In this case, the evaluation of the quantity of consumable remaining in the cartridges is done using means external to the cartridges themselves, possibly requiring the implementation of dedicated sensors as described in patent application WO2009047497 by the company Videojet. The solution according to this document consists of considering that the quantity of remaining fluid is connected by a characteristic to the vacuum created by the withdrawal of the fluid from a semi-rigid sealed cartridge. This solution requires the implementation of a dedicated pressure sensor.

In other words, the implementation of these utility functions requires the use of many components with their control (electronic) members.

By inventorying commercial solutions and solutions described in the literature, the inventors came to the conclusion that there are, to date, three categories of design solutions for performing the basic functions and, if applicable, utility functions, of continuous jet printer ink circuits:

1/ a category according to which most of the functions of a fluid circuit are implemented independently using distinct means dedicated to each function. This solution, very often adopted by the suppliers of continuous inkjet printers, has advantages: on one hand, the components can be perfectly dimensioned for the concerned function and therefore be technically high-performing, and on the other hand the interactions between functions are reduced, which makes the operation of the fluid circuit robust and easier to develop. However, the number of components and associated control interfaces, the difficulty of assembly and the resulting bulkiness of the system lead to prohibitive production costs and a non-optimal commercial situation.

2/ a category using the elements of the preceding category but with a decreased number of components, to the detriment of the performance of the printer or the service provided to the user. These machines are intended for highly cost-sensitive markets which tolerate the induced limitations. These printers cannot be proposed for demanding applications. One solution in this category is illustrated in patent application WO2007/129110 in the name of the company Domino: it consists of using the removable renewal tank as intermediate tank and consumable reserve. Moreover, the levels in the tanks are not measured using detectors, but the remaining quantities are evaluated from the knowledge of the initial volumes present in the renewal tanks at the time of the change and an estimate of the ink and solvent consumption. The major drawback is that the evaluation is approximate, which makes it necessary to signal empty tanks (to be changed) with a sufficient safety margin, in order to avoid the ingestion of air by the head, well before the tanks are completely empty. This results either in losing a large quantity of consumable, or requiring the user to visually monitor the level of the tanks, which is not practical. Moreover, the absence of an intermediate tank leads to stopping printing during the changing of the removable tanks in order to avoid ingesting air, which would lead to triggering time-consuming maintenance operations.

3/ the third category can be analyzed as design solutions which get around the drawbacks of those of the first category without making compromises on the essential needs of a good-level printer. Thus, here it is a matter of performing both types of functions (basic and utility) of the ink circuits using shared means. This makes it possible to use fewer components and ensure greater compactness of the fluid circuit, but at the cost of significant complexity and a delicate reliability to master. Patent application WO88/04235 by the applicant describes a compact fluid circuit where many functions (utility and basic) can be performed from a variable volume cell connected to a pressure sensor and a multitude of solenoid valves making it possible to withdraw and direct the fluids into different tanks. The different functions are managed sequentially (in series); this efficient system is still, however, particularly complex to develop due to the critical aspect of the timings between the phase of the variable volume cycle and the control of the solenoid valves. This is complicated by the need to manage the response time of the different actuators of the system. The specific characteristics of the variable volume cell make it a sensitive component developed on specific needs. The large number of solenoid valves poses a reliability problem which requires technically high performances.

In the end, the drawbacks of the continuous inkjet printer ink circuits of the prior art according to their design can be summarized as follows:

- ink circuits in which each function is performed independently of the other functions: they consist of an assembly of simple solutions, but use many components to be integrated and controlled, which leads to a bulky and costly assembly;
- circuits with a sophisticated design to decrease the number of components (cost), but the complexity and reliability-related risk increases, by adding the development difficulty. The need to develop non-standard hydraulic components impacts the cost-effectiveness of the final product;
- ink circuits with a very simplified architecture in order to obtain a low cost, but the technical and functional compromises lead to poor performance or decreased performance offered to the user and increased risk related to the feedback of insufficiently precise alarms.

An object of the invention is therefore to overcome all or part of the aforementioned drawbacks.

One aim of the invention is therefore to simply and reliably design a fluid circuit in a continuous inkjet printer which performs the basic functions and at least the utility function of determining the quantity of ink for printing.

Another aim of the invention is to propose a mechanical sub-assembly of a fluid circuit which performs at least the basic functions and at least the utility function of determining the quantity of ink for printing, which is simple and inexpensive to manufacture.

BRIEF DESCRIPTION OF THE INVENTION

To this end, the invention provides a measuring system in a fluid circuit of a continuous inkjet printer provided with a printing head, comprising:

- a first tank, of section S1 known over its entire height and adapted to be filled with ink and to supply the printing head with this pressurized ink and respectively to recover the fluids coming from the head and not used for printing,
- a second tank, of section S2 known over its entire height and whereof the bottom is hydraulically connected with the bottom of the first tank by a first hydraulic line comprising a first valve with complete closing, the second tank comprising a continuous level sensor adapted to continuously detect the height of a liquid over the entire height of the measuring tank, the inside of the first and second tanks being at the same gas pressure,
- means for establishing a forced hydraulic connection in ink from the second tank toward the first tank in order to completely empty the second tank.

In various embodiments, the intermediate tank may be a first tank, the measuring tank may be a second tank, the constant level tank may be a third tank, and the solvent tank may be a fourth tank.

According to the invention, control means are adapted to perform the opening of the first valve, once the complete emptying into the second tank is done, in order to establish filling of identical height H by the hydraulic communication between the first and second tanks, the system comprising calculating means adapted to determine the total volume of ink contained in the first tank and in the second tank from the detection of the identical height H by the continuous level sensor and the sections S1 and S2, the system thus constituting a system for measuring the quantity of ink.

Preferably, the means for establishing a forced hydraulic communication in ink from the second tank toward the first tank comprise a pump.

According to one embodiment of the invention, the continuous level sensor is constituted by a tube arranged vertically in the second tank with one end on the outside tightly connected to a pressure sensor, the pressure outside the measuring tank being the same as the gas pressure reigning inside, the pressure sensor thus operating relatively in reference to the pressure outside the second tank.

According to one complementary embodiment, the system comprises:

a third tank, of section S3 known over its entire height, the third tank being connected to the first tank by a second hydraulic line and comprising a second valve with complete closing, the bottom of the third tank also being in continuous hydraulic connection with the bottom of the second tank by a third hydraulic line comprising a calibrated hydraulic restrictor, the third tank also being arranged to be able to overflow over the first tank, means for establishing a forced hydraulic connection from the first toward the third tank.

According to this embodiment, the control means are adapted to successively realize the opening of the second valve during a forced hydraulic connection from the first toward the third tank until a constant level is established in the latter by overflowing into the first tank and the complete closing of the second valve, once the emptying into the second tank is complete and the constant level is established in the third tank, in order to establish on one hand filling of identical height by hydraulic communication between the first, second and third tanks, and on the other hand, a flow of ink at a constant pressure through the calibrated hydraulic restrictor and the calculating means of the measuring system are adapted on one hand to determine the volume of ink contained in the three tanks from the detection of the identical height by the continuous level sensor and the sections S1, S2 and S3 and on the other hand the viscosity μ of the ink from the evolution, over time, of the level measured by the continuous level sensor when the ink at constant pressure flows through the calibrated hydraulic restrictor, the system thereby also constituting a viscometer of the ink for printing.

According to one advantageous variant, the calculating means are adapted to determine the viscosity μ, from the evolution of the level measured by the continuous level sensor as a function of time taken by the ink at constant pressure which flows through the calibrated hydraulic restrictor to pass between two known fluid levels detected by the continuous level sensor.

Preferably, each tank has a constant section (S1, S2, S3) over its entire height.

According to another complementary embodiment, also provided are:

a fourth tank, adapted to be filled with solvent, means for establishing a forced hydraulic communication from the fourth tank toward the second tank in order to bring the solvent therein. According to this embodiment, the calculating means also being adapted to determine the height h' of solvent to be brought into the second tank from the knowledge of a calculated viscosity μ. According to this embodiment, the control means are adapted to interrupt the supply of solvent in the second tank by forced hydraulic connection, once the height h' is detected by the continuous level sensor, the system thereby also constituting a viscosity corrector for the ink for printing.

Preferably, the fourth tank is adapted to be able to overflow into the second tank.

Preferably, the means for establishing a forced hydraulic communication from the fourth tank toward the second tank in order to bring solvent therein comprise a pump.

The invention also concerns a fluid circuit of a continuous inkjet printer comprising a printing head, implementing a measuring system previously described, in which the bottom of the first tank is connected with the drop generator of the printing head via a pump called the supply pump, and with the gutter for recovering fluids coming from the head and not used for printing via a hydro-ejector, the hydro-ejector being connected to the supply pump such that in its operating state, it causes the suction of the ink recovered in the gutter toward the first tank.

The circuit can also comprise a removable ink cartridge adapted to fill the first tank by forced hydraulic communication. The pump for emptying the second tank toward the first tank is then advantageously the pump which makes it possible to fill the first tank by forced hydraulic communication from the removable ink cartridge.

The circuit can also comprise a removable solvent cartridge adapted to fill the fourth tank by forced hydraulic communication. The pump for supplying solvent in the second tank is then advantageously the pump which makes it possible to supply the drop generator with solvent in order to clean it.

In this type of circuit, the first tank preferably comprises:

a vent in its top part;

a passive condenser in permanent communication with the vent and constituted by a cavity provided with baffles to condense the solvent vapors coming from the gas recovered by the gutter via the hydro-ejector.

The invention lastly concerns a block designed to implement a measuring system previously described, comprising an envelope fastened between two base plates, and inside of which three tubes are arranged fastened orthogonally to one of the base plates, called lower base plate, and arranged at a distance from the upper base plate, the volume between the three tubes and the envelope being designed to constitute the first tank while each of the tubes is designed to constitute the second, third and fourth tanks, respectively.

One thus defines a mechanical assembly for implementing all of the basic and utility functions which is compact, and simple and less expensive to manufacture and assemble.

In order to further simplify production, the tubes preferably have a circular section.

In order to make the part of the fluid circuit dedicated to the measuring system according to the invention even more compact, it is advantageously possible to:

have the first and second valves, of the solenoid valve type, supported by the lower base plate, fasten the pump for emptying the ink from the second tank to the lower base plate, fasten the pump for supplying solvent in the second tank from the fourth tank to the upper base plate.

A pressure sensor can also be supported, said pressure sensor being part of the continuous level sensor, by the upper base plate.

BRIEF DESCRIPTION OF THE DRAWINGS

Other advantages and characteristics will better emerge upon reading the detailed description of the invention, made as an illustration and non limitative, in reference to the following figures among which.

DETAILED DESCRIPTION OF PARTICULAR EMBODIMENTS

Figure 1:
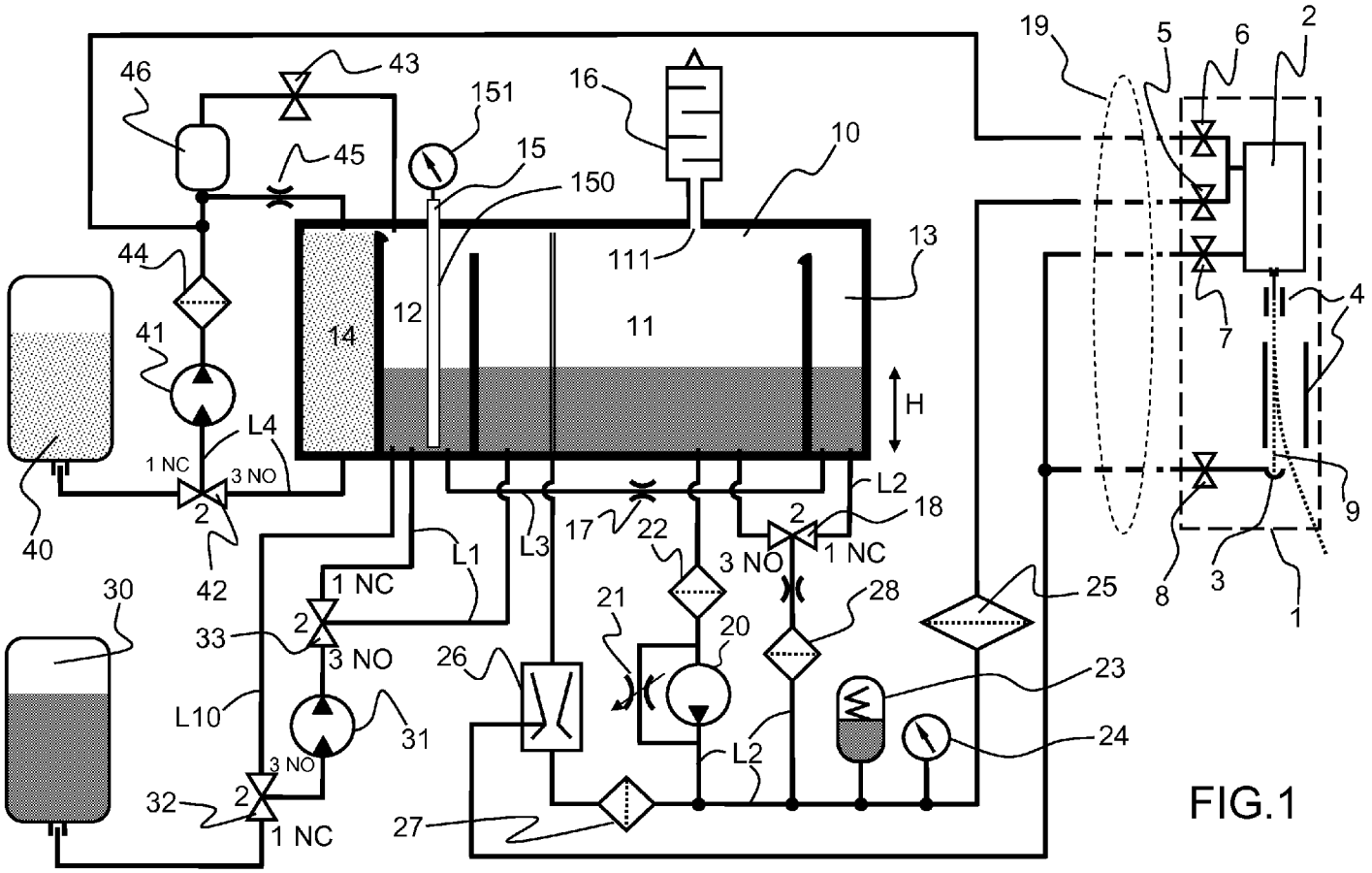
FIG. 1 is a hydraulic diagram of the continuous inkjet printer fluid circuit implementing the measuring system according to the invention.

FIG. 1 shows a hydraulic diagram of the fluid circuit according to the invention, of a multi-deflected continuous inkjet printer with its printing head 1.

The head 1 comprises a drop generator 2 and a recovery gutter 3. It integrates four solenoid valves 5, 6, 7, 8 each connected to one of the four hydraulic conduits entering the head through the umbilical 19.

The ink-head solenoid valve 5 allows, in the open position, the supply of the drop generator 2 with pressurized ink.

The solvent-head solenoid valve 6 allows, in the open position, the supply of the drop generator 2 with pressurized solvent.

The purge solenoid valve 7 allows, in the open position, during certain maintenance operations, connection of the drop generator 2 to a vacuum source.

The gutter solenoid valve 8 allows, in the closed position, isolation of the gutter 3 when no jet 9 of ink is emitted by the drop generator. This prohibits air from entering when the jet 9 is not emitted in order to minimize the evaporation of the solvent in the fluid circuit.

The gutter 3 is permanently connected in printing operation (solenoid valve 8 open), through the umbilical 19, to a vacuum source situated in the fluid circuit.

The maintenance operations of the head are done by specific sequencings of openings and closings of these solenoid valves controlled by a controller of the printer, not shown. This controller integrates all of the control and calculating means according to the invention. The sequencings enable the implementation of functions of the fluid circuit described below.

We will now describe how the basic functions (supply of pressurized ink to the head 1, suction of fluids returning from the head) are done in the fluid circuit according to the invention.

Regarding the supply of pressurized ink, the ink intended for the head 1 is drawn in an intermediate tank 11. Such a tank can be qualified here and in the context of the invention as intermediate because it constitutes a storage-buffer tank in which the ink is stored in a part of the fluid circuit which is intermediate between the ink 30 and solvent 40 cartridges (removable consumables cartridges) and the printing head 1 strictly speaking. The fluids returning from the head are recovered by this same intermediate tank 11.

The ink contained in the tank 11 is maintained with the required quality for optimal printing operation, in particular adjusted in viscosity, as described below using the system according to the invention.

After being crudely filtered by the filter-grid 22, the ink withdrawn in the intermediate tank 11 arrives at the inlet of the gear pump 20 which pressurizes it. This pump 20 is driven by a motor controlled in speed (power) by the controller. The pump 20 can be by-passed by an adjustable bypass 21 in order to adjust its operating range (pressure/flow or pressure/speed of rotation characteristic). At the outlet of the gear pump 20, the average pressure undergoes an undulation the frequency of which is related to the speed of rotation and the number of teeth of the gears. This undulation can disrupt the speed of the drops in flight which depends directly on the pressure of the ink and as a result also influences the deflection amplitude of the drops during printing, which would degrade the marking quality. This is why an anti-pulse device 23 is advantageously provided downstream from the pump 20. This anti-pulse device 23 preferably consists of a deformable resilient envelope containing a volume of gas and submerged in the pressurized ink, which makes it possible to damp these undulations at the outlet of the pump 20. The characteristics of the anti-pulse device 23 are determined according to the average operating point of the pump.

A pressure sensor 24 is provided downstream from the anti-pulse device 23: its data are used by the controller to control the pressure of the ink according to a set point, generally when the inkjet speed in the head is not available (for example when the ejection of the jet is stopped, or the jet speed cannot be measured). In jet speed control mode, as is the case when one wishes to print with good quality, the pressure sensor 24 is used as an indicator to monitor the operation of the printer. Moreover, one can provide a pressure sensor technology which makes it possible also to obtain the temperature of the ink, which is useful in managing the control of the ink viscosity.

The ink is lastly filtered by the main filter 25 downstream from the sensor 24 before being sent to the head 1. The main filter 25 has the filtration grade and capacity making it possible to protect the nozzle during a very long period before the need for a maintenance intervention on the printer.

The fluids not used for printing are sucked at the head (recovered by the gutter or returning from purge) through the umbilical with the help of a hydro-ejector 26. In the fluid circuit according to the invention, the hydro-ejector 26 uses part of the flow from the pump 20 as driving energy to create a vacuum by Venturi effect. In other words, the excess flow driven back by the pump 20 is used, after filtering by the filter grid 27, to bring the pressurized ink into the hydro-ejector 26 which thus creates the vacuum necessary to drive the fluids returning from the head 1 toward the intermediate tank 11. The filter-grid 27 serves to protect the injector (fine restrictor) of the hydro-ejector 26.

As is known, starting and stopping the jet are two delicate operations.

Their sequencing must be optimized to ensure proper and reliable start-ups of the jet even after long stops. In the circuit according to the invention, these operations generally unfold as follows:

upon stopping of the jet, the jet is passed in solvent to clean the drop generator 2 and the nozzle, then the purge and gutter 3 circuits (including their solenoid valves 7 and 8) are rinsed and to finish the solvent is sucked from the drop generator 2 and the gutter 3 before closing all of the solenoid valves 5, 6, 7, 8 of the head;

upon starting up of the jet, after opening the gutter 3, the drop generator 2 is supplied with pressurized solvent then, during a purge, the solenoid valve 5 is opened for some time before closing the solenoid valve 6: the jet passes progressively from the solvent to the flow of the ink without destabilizing. The sequencing of these operations must be watched to guarantee the stability of the jet during switches between fluids of different viscosities: the ink and solvent are supplied to the head with close pressure values and good stability of these pressures for both fluids.

We will now describe one embodiment of the measuring system according to the invention implemented in the illustrated fluid circuit.

The system comprises a single container 10 partially partitioned defining four functional tanks 11, 12, 13, 14 connected to each other and to two removable cartridges of reserve consumables (ink cartridge 30 and solvent cartridge 40) by conduits or passages and some active hydraulic components (controlled by the controller) such as four 3-way solenoid valves 18, 32, 33, 42, a 2-way solenoid valve 43 and two low-capacity diaphragm pumps 31, 41. The ink cartridge 30 and the solvent cartridge 40 make it possible to replace the fluids consumed by the printer during its continuous operation. These cartridges do not have any of their own means for measuring or detecting the volume of fluid they contain. The cartridges connect to bases associated to the corresponding solenoid valves 32, 42.

More precisely, the sole container 10, the bottom of which is flat and horizontal, comprises internal partition walls present on only a part of its height, dividing it into four tanks 11, 12, 13, 14 opening onto the height in a shared volume. The four tanks 11, 12, 13, 14 are therefore balanced at an identical gas pressure. The shared volume inside the container 10 is in communication with the outside air through a vent 111. Thanks to this vent, the air charged with solvent vapor from the driving back of the hydro-ejector 26 which sucks the fluids (mix of ink and air entering the gutter 3 of the printing head 1) is allowed to escape toward the outside. Before reaching the open air, this solvent vapor-charged air passes through a passive condenser 16 constituted by a cavity provided with baffles which expand the contact surface between the charged air and the walls of the condenser. Such a condenser 16 makes it possible to condense, on its walls, part of the vapors from the solvent which return by gravity into the intermediate tank 11. The air which escapes from the passive condenser 16 may pass through an active condenser (not shown in the figure) cooled by Peltier cell or other system known by one skilled in the art.

As explained below, according to the measuring functions of the system according to the invention (utility functions of the circuit), each tank 11, 12, 13, 14 is more or less filled with fluid. Because the partition walls are not realized up to the top of the container 10, a full tank can overflow into the adjacent tank. Thus, as explained below, the tank 13 is used as constant level tank by overflowing into the intermediate tank.

As previously explained, the intermediate tank 11 is that which contains the ink designed to be pressurized and to supply the printing head 1 and to recover the fluids coming from the return there from via the gutter 3. This tank 11 is that which has the largest contents, typically 1300 $cm^3$.

The second tank 12 is the measuring tank because it is therein that the measurements strictly speaking of the ink and solvent levels are done using a continuous level sensor 15 which equips it.

The third tank 13 is supplied, in closed circuit, with the ink coming from the intermediate tank 11 to constitute a constant level tank by overflow toward the intermediate tank 11. More precisely, the ink is pumped using the supply pump 20 from the intermediate tank 11 to the tank 13 by driving back through the filter-grid 28 and the solenoid valve 18 in position NC (1-2). Thus, filled at a constant level, the tank 13 supplies ink with a constant static pressure making it possible to perform a viscometer function which will be described later. The constant level tank 13 is in continuous hydraulic communication with the measuring chamber 12 using a conduit L3 connecting their bottom, provided with a calibrated hydraulic restrictor 17. The calibrated restrictor 17 is, in the technological sense of the term, a viscous restrictor with a length significantly larger than its diameter.

The fourth tank 14 constitutes a solvent tank serving for rinsing of the head during the start and stop operations of the jet. This tank 14 also makes it possible to extend the operation of the printer when the solvent cartridge 40 is empty, by supplying the solvent necessary to correct viscosity and thereby provides the user with the possibility of deferring replacement of the empty cartridge. This tank 14 can overflow into the measuring tank 12.

In order to transfer ink or solvent to the intermediate tank 11, two sub-assemblies are provided each comprising a pump connected to two solenoid valves constituting a sub-assembly dedicated to the transfer of one of the fluids.

Thus for the transfer of ink, a sub-assembly comprises the pump 31 associated with the solenoid valves 32, 33. This makes it possible on one hand to transfer new ink from the cartridge 30 toward the intermediate tank 11 and on the other hand, to empty the measuring tank 12 toward the intermediate tank 11.

For the transfer of solvent, another sub-assembly comprises the pump 41 connected to the solenoid valves 42, 43. This makes it possible on one hand to transfer determined quantities of solvent toward the measuring tank 12, either from the solvent cartridge 40 toward the solvent tank 14 by overflowing into the tank 12, or from the solvent tank 14 toward the measuring tank 12 and on the other hand, to pressurize the solvent, coming from the solvent tank 14, for rinsing of the head during stops and starts of the jet.

Thus, with the exception of the supply of solvent (hydraulic line L4) coming from the solvent transfer pump 41, the hydraulic lines L1, L2, L10, L3 connected to the container 10 are connected only at the level of its flat and horizontal bottom, which is that of the four tanks 11, 12, 13 and 14, which allows communications of fluid by communicating vessel used as explained below.

As indicated above, the sensor 15 is a continuous level sensor: it is therefore capable of measuring any level of fluid present in the measuring tank 12. Thus, the system according to the invention can, by performing level measurements cyclically, know and exploit the evolution of the level over time. As shown, the continuous level sensor 15 is constituted by a pressure sensor 151 tightly connected to one end of a tube 150, the other end of the tube being open. The tube 150 is arranged vertically in the measuring tank 12 such that the opening of the tube opens near the bottom. There are, of course, other devices known by those skilled in the art making it possible to measure a continuous level such as ultrasound sensors, capacitive sensors or others. It is, however, necessary to ensure that the device used is explosion-proof given the flammable nature of the fluids used (ink, solvent).

The pressure sensor 151 measures the static pressure Pstat of the column of fluid present in the measuring tank 12. The pressure of the gas above the liquid surfaces in the container 10 is in that identical to the pressure of the external air where the sensor 151, which operates as a relative pressure sensor with external pressure reference, is located. From the knowledge of the nominal density d of the fluid under consideration, the controller deduces the height h of the column and therefore the fluid level according to the following well-known equation:

$$h=(1/g)*Pstat/d$$

in which g is the gravity acceleration.

Figure 5:
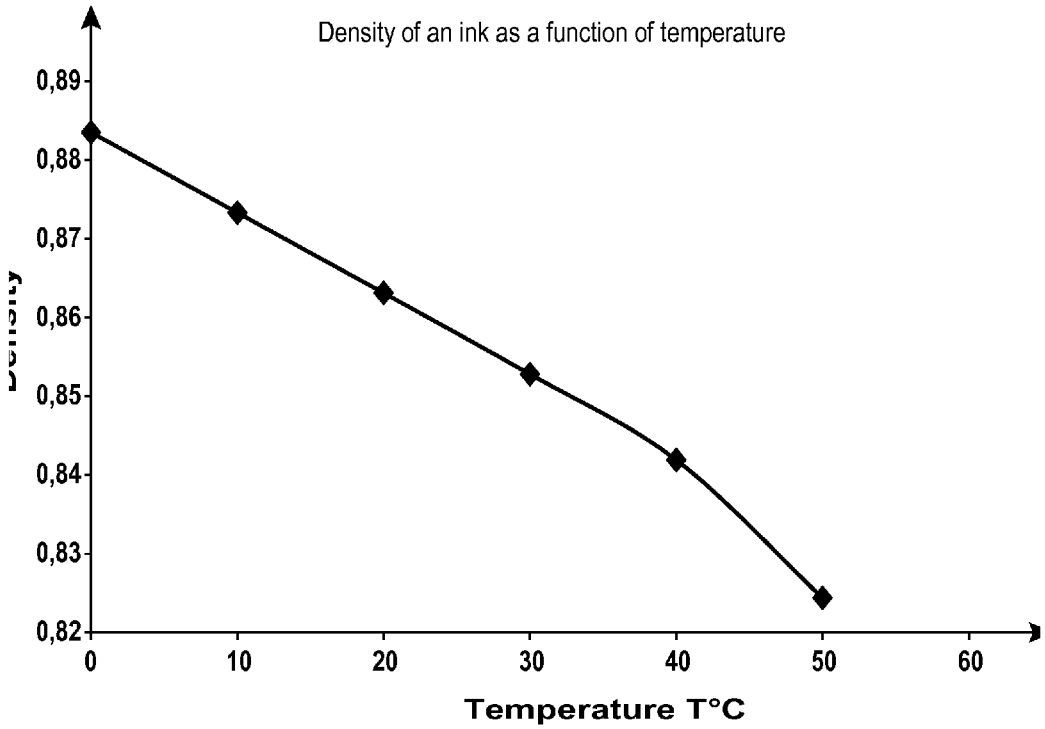
FIG. 5 shows the evolution of ink density as a function of temperature for a given ink adapted to be used in a printer according to the invention.

Depending of the ink type, the density may vary slightly as a function of the temperature as shown on FIG. 5 for a given ink adapted to be used in a printer according to the invention. Consequently, in order to improve the precision of the measured level, the density d may be determined as a function of the taken temperature, at the instant of the measurement.

Periodically, the sensor 151 is calibrated: the offset of the sensor, which determines the zero level, is measured after complete emptying of the measuring tank 12, i.e. after emptying to below the level of the opening of the tube 150. The complete emptying of the measuring tank 12 is done as follows:

- the solenoid valve 32 is switched to position NO (2-3), which connects the bottom of the measuring tank 12 with the inlet of the ink transfer pump 31 (hydraulic line L10);
- the solenoid valve 33 is switched to position NO (2-3), which connects the outlet of the ink transfer pump 31 with the bottom of the intermediate tank 11 (right part of line L1);
- the ink transfer pump 31 is activated and a cyclical level measurement is done until the low level of the measuring tank 12 is reached.

The utility functions of the fluid circuit or in other words, the functions of the measuring system according to the invention are performed, as desired, by the controller of the printer.

For the measuring functions of the quantity of ink and the viscosity, the flow of the ink transfer pump 31 is essentially more significant than the flow of ink coming from the constant level tank 13 toward the measuring tank 12 through the line L3.

Measuring the Quantity of Ink Remaining in the Container and Critical Levels Test:

After calibration of the continuous level sensor 15 (as previously described), the measuring tank 12 and the intermediate tank 11 are hydraulically connected by their bottom by switching the solenoid valve 33 into position NC (1-2). The ink withdrawn at the outlet of the ink pressurizing pump 20 is directed toward the intermediate tank (solenoid valve 18 in position NO (2-3)). As the constant level tank 13 is continuously connected with the measuring tank 12, through the calibrated restrictor 17 by the line L3, the levels of the volumes considered in the tanks 11, 12, 13 tend, after equilibrium, toward a single value (height H illustrated in FIG. 1) which is measured by the sensor 15. Knowing the area of the sections of the three tanks 11, 12, 13, the controller deduces the exact volume of ink available; this is ink ready for printing, i.e. of suitable quality (viscosity).

Comparing this level with predetermined thresholds also allows the controller to manage critical levels:

- exceeding a level having a risk of overflowing the container 10;
- reaching a lower level that requires the replenishment of ink, by transfer of the new ink from the ink cartridge 30, without risk of overflowing the intermediate tank 11;
- reaching an even lower level which requires stopping of the consumption of ink (printing) to avoid the ingestion of air by the head through the ink pressure circuit.

Measuring Viscosity of the Ink Intended to be Pressurized and to Supply the Head 1:

The function is performed from the measurement of the time needed for a volume of ink, defined between two predetermined values provided by the level sensor 15, coming from the constant level tank 13 (constant charge) to flow through the calibrated hydraulic restrictor 17. This measured time is connected to the viscosity of the ink using characteristic curves previously established with the same measurement protocol for each type of ink and over the entire temperature range of use.

The controller first controls the positioning of the solenoid valve 18 in position NC (2-1), so that the constant level tank 13 is continuously supplied with the ink withdrawn at the outlet of the ink pressurizing pump 20. After emptying the measuring tank 12 and isolating it from the intermediate tank 11 (stopping of the pump 31, solenoid valve 33 in position NO (2-3)), the measuring tank 12 fills by the flow through the line L3 provided with the calibrated restrictor 17. The time duration is measured between the instants when the height of fluid in the measuring tank passes at two given level values that determine a given volume, this flow time duration being representative of the viscosity at a given temperature.

Control of the Addition of Solvent to Adjust Viscosity:

Thanks to the functions mentioned above knowing the exact volume and the viscosity of the ink contained in the container 10, measured using the functions described above, the controller can calculate the viscosity gap between the measured value and a setting value determined previously in an experimental way at the same temperature than the one of the measure and thus can determine precisely, in case of a too low viscosity, the quantity of solvent to add in order to regain the nominal viscosity, from characteristics connecting the dilution level of the ink and its viscosity or a parameter representative of its viscosity. These characteristics are determined beforehand for each type of ink and stored in the printer.

The quantity of solvent to add is converted into difference between levels in the measuring tank 12, taking into account if necessary the influency of the blend density on the level measurement, as explained above. Depending on the filling state of the solvent cartridge 40 (not empty or empty), solvent serving to correct the viscosity can be brought either from the solvent cartridge 40 or from the solvent tank 14:

- if the solvent cartridge 40 is not empty: the cartridge is connected to the inlet of the solvent transfer pump 41 (solenoid valve 42 in position NC (2-1)) and the solenoid valve 43 is closed. When the pump 41 is turned on, it delivers in the solvent tank 14. Once this is full, it overflows into the measuring tank 12, the measured level of which one ensures beforehand is not null.
- if the solvent cartridge 40 is empty or absent, the solvent tank 14 is connected to the inlet of the solvent transfer pump 41 (solenoid valve 42 in position NO (2-3)) and the solenoid valve 43 is open. When the solvent transfer pump 41 is turned on, it delivers in part in the solvent tank 14 and in part in the measuring tank 12 (solenoid valve 43 open).

Whatever the case may be, the controller then begins the cyclical measurement of the level of solvent added until the desired solvent level is obtained. The level is corrected by deducing the quantity of ink continuously brought from the constant level tank 13.

The measuring tank 12 is then emptied into the intermediate tank 11.

Mixing of the ink by ink recycling through the solenoid valve 18 in position NO (2-3) allows homogenization of the viscosity. More precisely, the solenoid valve 18 is in position NO (2-3), the pump 20 is turned on, the ink coming from the intermediate tank 11 is withdrawn by the ink pressurizing pump 20 and redirected toward this same intermediate tank 11 to contribute to the homogenization of the ink by mixing.

Test for the Presence of a New Non-Empty Ink Cartridge 30:

This test is done in three steps:

1/ the controller launches a first measurement of the volume of ink in the tanks 11, 12 and 13, as described above, 2/ a small quantity of ink is withdrawn in the cartridge 30 using the ink transfer pump 31 (solenoid valve 32 in position NC (2-1)) and is directed toward the intermediate tank 11 (solenoid valve 33 switched to position NO (2-3), which cuts the hydraulic line L1 between the measuring tank 12 and the intermediate tank 11), 3/ the solenoid valve 33 is again switched into position NC (2-1) to balance the three tanks, and a second measurement of the volume of ink therein is done as described above.

The comparison with the first measurement then makes it possible to see whether there is a difference in ink volume. Thus, if this difference exists, the ink transfer was indeed effective and this confirms the presence of a non-empty ink cartridge 30 connected to the fluid circuit. In the event no difference is observed, the ink cartridge 30 is empty or absent.

Control of the Transfer of Ink Between Cartridge and Intermediate Tank:

When the level in the container 10 allows it and a new ink cartridge is present (its maximum capacity is assumed to be known), the controller can decide to transfer the content of the ink cartridge into the tank. The transfer takes place in several times with monitoring of the level in the tank upon each transfer in order to avoid overflow into the main tank 10. Steps 2 and 3 of the preceding function are linked several times with, in step 2, a more significant quantity of ink in order to limit the number of transfers.

The process continues until the level of the tank no longer evolves: the cartridge is then transferred completely or until the level exceeds a safety value, in this case the capacity of the cartridge is not as expected.

Test of Complete Emptying of the Solvent Cartridge 40:

This test is performed when adding solvent to correct the viscosity of the ink. As mentioned above, an addition of solvent from the cartridge 40 leads to filling the solvent tank 14 until it overflows into the measuring tank 12 in which the level variation is measured. If this variation is not observed, the solvent cartridge 40 is empty.

A change of solvent cartridge automatically resets the situation once an addition of solvent is requested from a new cartridge.

Pressurization of the Solvent for Rinsing of the Head During Stops and Starts of the Jet:

As mentioned above, the need to supply the head with pressurized solvent only occurs during the stops and starts of the jet, typically one to two times per day.

The diaphragm pump 41 is used to pressurize the solvent only during these stops/starts of the jet. For this operation, the solvent is always taken from the solvent tank 14 (solenoid valve 42 in position NO (2-3)), which is refilled at the next addition of solvent to correct the viscosity.

The performance of the pump 41 chosen is such that:

- it provides pressure of the same order as that which the ink must have at the head in order to print (approximately 2 to 3 bars);
- it delivers a necessary flow to recycle the solvent in the solvent tank 14 through the restrictor 45;
- it delivers a sufficient flow to emit a jet through the nozzle of the generator 2.

However, as known by the inventors, this type of diaphragm pump generates very significant pressure undulations, typically around 1 bar. The inventors thus considered that, without a particular device, these pressure variations would cause harmful instabilities of the jet(s). Thus, the inventors defined a simple damping device implemented as follows.

Prior to pressurizing the solvent and outside the solvent transfer operation, the solenoid valve 43 is opened for a sufficiently long time for the cavity 46 to empty by gravity toward the solvent tank 14 through the calibrated restrictor 45. Once the solenoid valve 43 is closed, the air bubble in the cavity 46 remains in the solvent circuit downstream from the solvent transfer pump 41.

When the pump 41 is turned on, the solvent-head solenoid valve 6 is first not open: the excessive pressure undulations generated by the diaphragm pump 41 are damped by the damping device constituted by the air bubble associated with the restrictor 45.

When the pressure has stabilized after a certain time, the pressurized solvent can be used during stop/start sequencings. Indeed, the performances are sufficient to obtain a directive and stable jet of solvent at the opening of the solvent-head solenoid valve 6.

The inventors have also realized a block designed to implement all of the measuring functions of the system according to the invention (utility functions of the fluid circuit), which is compact and easy to manufacture and assemble.

Figure 2:
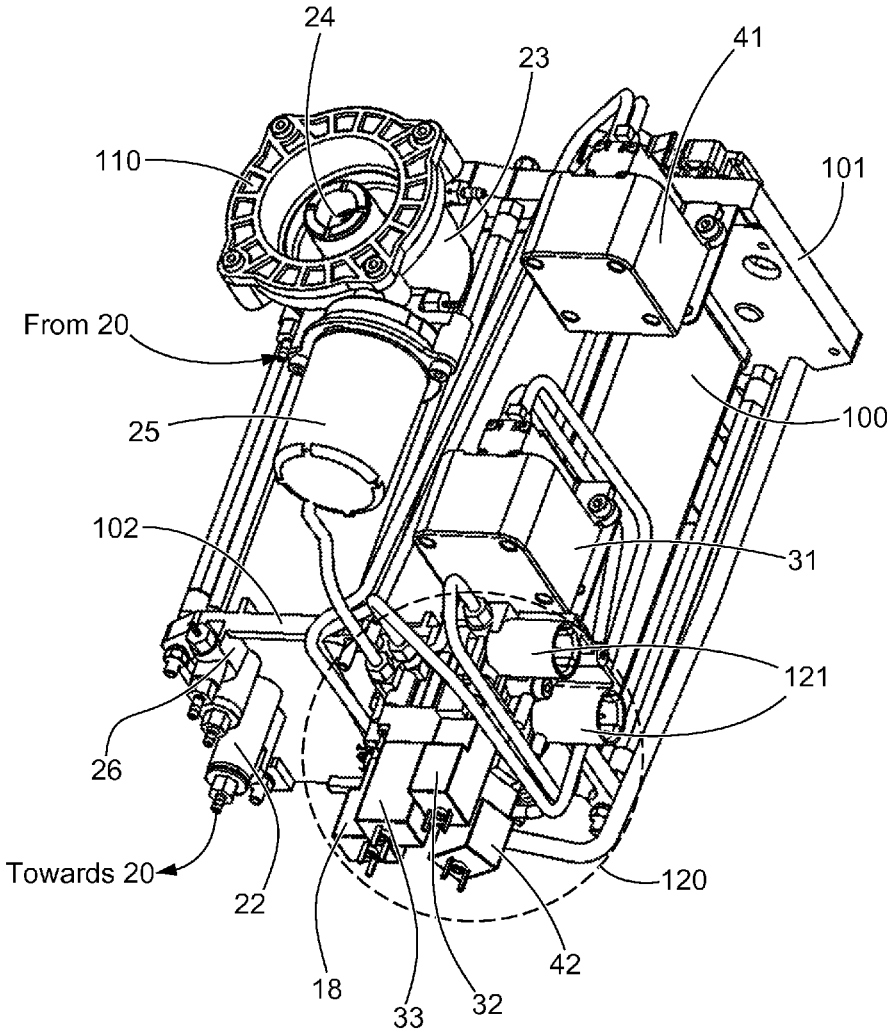
FIG. 2 is an internal transparency view of a block designed to implement the measuring system according to the invention.

The block illustrated in internal transparency view in FIG. 2 is realized from an envelope 100 (made transparent in FIG. 2 and visible in FIGS. 3 and 4) which constitutes the sole container 10.

This envelope 100 is constituted by a tube portion of rectangular section closed by an upper base plate 101 and a lower base plate 102. The components of the fluid circuit according to the invention are both independent and connected by pipes, or directly fastened on the base plates 101 and 102, or assembled together constituting macro-components subsequently integrated into the unit.

Thus, the tanks inside the envelope 100 are realized from tubes of circular section 12, 13, 14 taken between the two base plates 101, 102 (illustrated in FIG. 2). This makes it possible to produce a compact, inexpensive structure that is easy to assemble. Inside the envelope the three tubes 12, 13, 14 are therefore arranged fastened orthogonally to the lower base plate 102 and arranged at a distance from the upper base plate 101. The working volume between the three tubes 12, 13, 14 and the envelope 100 constitutes the volume of the intermediate tank 11.

The sections of the tubes as well as that of the rectangular envelope 100 of the container are chosen carefully such that:

- the working volume of the intermediate tank 11 can contain at least the sum of the volume of ink allowing a minimum guaranteed volume of ink, the volume of the reserve ink cartridge and an additional volume for operating safety in order to avoid overflows under all circumstances (preferably around 1300 $cm^3$);
- the volume of the solvent tank 14 can contain the volume of solvent allowing a minimum guaranteed working autonomy under the least favorable conditions before replacement of the empty solvent cartridge (preferably around 150 $cm^3$);

the volume of the constant level tank 13 is minimal in order to be as compact as possible but easily manufacturable (a tube with a section preferably around 0.8 $cm^2$);

the surface of the working section of the measuring tank 12 is compatible with the desired precision on the volume measurement of solvent added to correct the viscosity of the ink or on the volume measurement of ink having flowed from the constant level tank 13 in order to measure viscosity, taking into account the measuring precision of the level provided by the continuous level sensor 15 (a tube with a section preferably around 1.5 $cm^2$).

Preferably, the base plates 101, 102 are each constituted by a molded plastic piece including a certain number of fastening elements (tapped inserts or holes to fasten components directly on the base plates), hydraulic connections (through pieces, small conduits made directly in the thickness of the base plates), parts of components directly molded with the base plate. Whatever the fastening elements, connections or integrated components, one ensures that the molding of such base plates remains of reasonable complexity (low cost).

Figure 3:
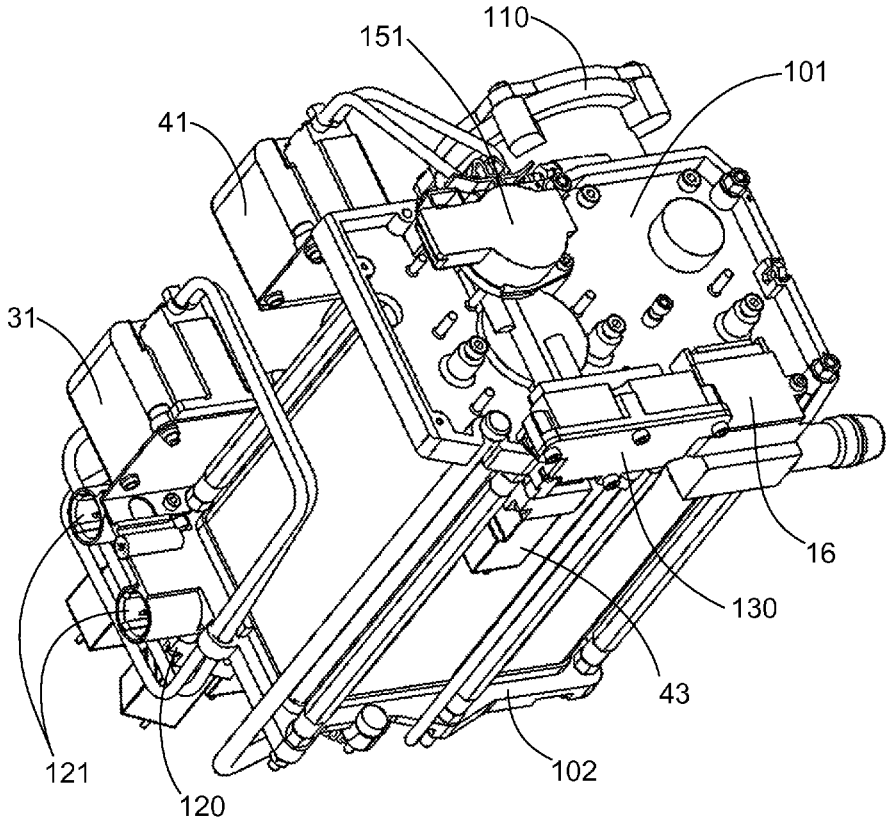
FIG. 3 is a three-dimensional wireframe low angle view from below, of the block according to FIG. 2 in which the means according to the invention have been integrated.

As shown in FIG. 3, the lower base plate 102 preferably integrates the bodies of the hydro-ejector 26 and the filter 22, as well as a switching block 120 which interfaces the four solenoid valves 18, 32, 33, 42 with the two connection bases 121 of the solvent 30 and ink 40 cartridges (not shown) and to the bottoms of the container 10. The four solenoid valves 18, 32, 33, 42 are grouped together in a switching block 120 integrated directly under the lower base plate 102 opposite the concerned tanks 13, 12, 14, respectively, with access conduits formed by simple through-pieces of the base plate.

The upper base plate 101 advantageously integrates a part of the solvent vapor condensation system 16 in the vent output and the hydraulic interface with a solvent supply block 130 which comprises, in reference to FIG. 1, the solenoid valve 43, the cavity of the air bubble 46 and the restriction 45.

The upper base plate 101 advantageously supports the pressure cell 151 of the level sensor.

Figure 4:
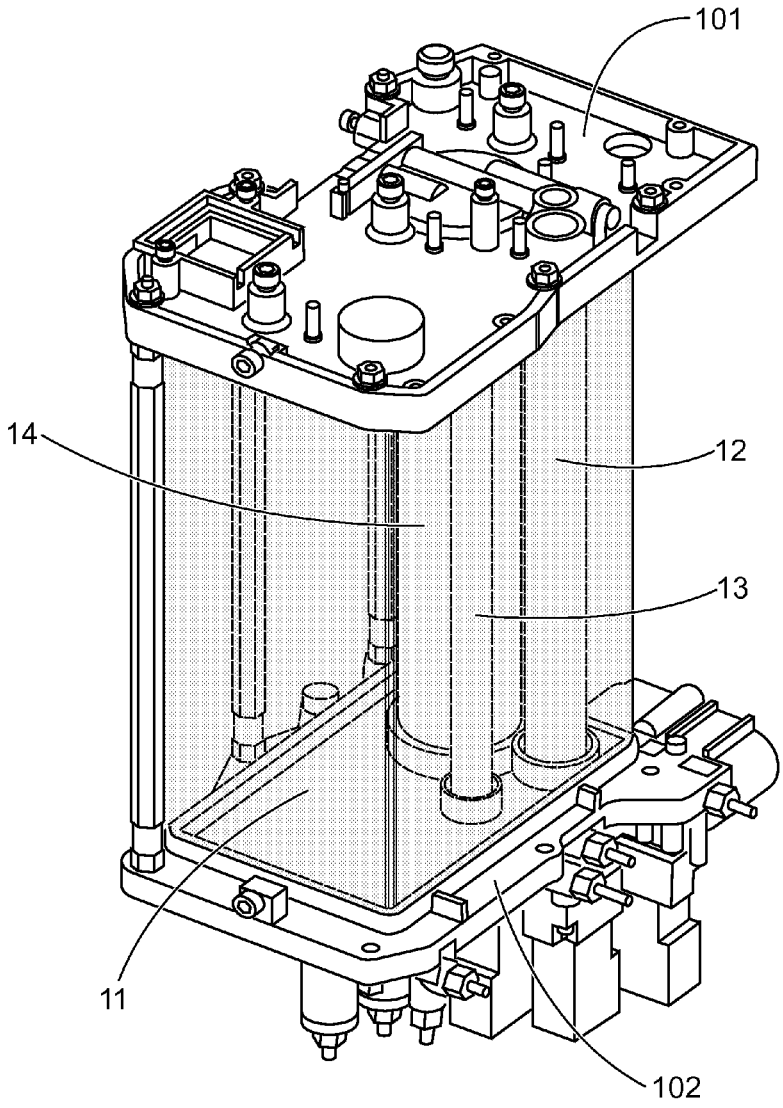
FIG. 4 is a three-dimensional wire-frame low angle view, from the top of the block according to FIG. 3.

As shown in FIGS. 3 and 4, the auxiliary diaphragm pumps 31, 41 are advantageously independent and fastened directly to the base plates 101, 102, with easy access for their maintenance.

Moreover, the components implementing the basic functions of the fluid circuit of the invention are reported on the block of the measuring system according to the invention as follows.

A supply block of pressurized ink 110 or pressurization block, compactly integrates the anti-pulse device 23, the pressure/temperature sensor 24, the main filter 25 and the protection filters 27, 28. As shown in the figures, the inventors preferred to make:

the anti-pulse device 23 in the form of a sealed, hydroformed metallic bellows containing a slightly pressurized inert gas;

the integration of the pressure/temperature sensor 24 by direct insertion into the cavity of the anti-pulse device (FIG. 3);

the main filter 25 in the form of an easily replaceable filtering cartridge and adapted to connect directly on the cavity of the anti-pulse device 23;

a protection of the main filter 25 by a sealed enclosure easily lockable for maintenance.

Moreover, the pump for pressurizing the ink 20 integrates the bypass 21 and is an independent component connected upstream, at the outlet of the filter 22 integrated into the lower base plate 102 of the container 10 and downstream, to the supply block 110. This configuration makes it possible to place the motor of the pump outside the fluid circuit enclosure in order to optimize the thermal behaviour of the printer.

As shown in FIG. 3, the hydro-ejector 26 is integrated into the lower base plate 102. Its outlet passes through the lower base plate 102 opposite to the intermediate tank 11 and is extended by a pipe opening just under the upper base plate 101 (not shown). This hydro-ejector 26 is itself connected upstream by a pipe (not shown) to the outlet of the pressure pump 20 next to the pressurization block 110. The vacuum inlet of the hydro-ejector 26 is connected by pipe (not shown) to the two conduits of the umbilical (not shown). The integration of the hydro-ejector 26 as close as possible to the intermediate tank 11 makes it possible to maximize its performance while minimizing its loss of fluid pressure-head in output. Its injector (with restriction) is a component which can easily be disassembled for maintenance.

The invention provides many advantages:

it has the advantages of the three categories of design solutions for fluid circuits according to the prior art mentioned in the preamble, without suffering from most of their drawbacks;

it makes it possible to perform precise measurements of the volume of ink and added solvent, which allows precise control of the ink quality;

it makes it possible to perform measurements and constitute reserves of fluids allowing the user to resupply the machine with consumables without constraint on the change timeframe for consumable cartridges (ink, solvent);

it makes it possible to produce a simple fluid circuit (using few components) which is reliable (little interaction between functions), without concessions on the performance (very precise ink quantity and viscosity control) and an optimal cost (easy production, molded pieces not very complex, easy assembly);

it combines advanced integration techniques with efficiency, from the performance/cost ratio perspective: among others, it allows the connection of independent standard components with specifically developed macro-components, it also connects hydraulic connections by pipes, by simple through-pieces or by conduits integrated into the mass of easy-to-manufacture base plates;

it allows a simple and quick fluid circuit assembly using a block having a general structure constituted by profiled tubes taken between two base plates;

it makes it possible to produce a compact fluid circuit;

because it simplifies the fluid circuit, the operation of the latter is made much more sound and predictable;

it makes it possible to separate basic and utility functions of the fluid circuit, which leaves the possibility of dimensioning and choosing the components of each function optimally in terms of performance and cost;

Other embodiments and improvements can also be contemplated without going beyond the scope of the invention.

Thus, while the system for measuring the quantity of ink and its associated block provides for the use of the constant level tank 13, and therefore the measurement of the level H in the three tanks 11, 12, and 13, one can also consider a system for measuring the quantity of ink with only the intermediate tank 11 and the measuring tank 12 with complete emptying thereof into the intermediate tank before forming a connection by communicating vessel between the two in order to measure the identical ink height which they contain.

The invention claimed is:

1. A measuring system in a fluid circuit of a continuous inkjet printer provided with a printing head, the system comprising:

a first tank having a first section extending over a height of the first tank and adapted to be filled with ink and to supply the printing head with pressurized ink therefrom and to recover fluids coming from the head and not used for printing;

a second tank having a second section extending over a height of the second tank and having a bottom which is hydraulically connected with a bottom of the first tank by a first hydraulic line comprising a first valve, the second tank comprising a continuous level sensor adapted to detect a height of a liquid in said second tank, a gas pressure of an inside of the first and second tanks being at a same gas pressure;

means for establishing a forced hydraulic communication in ink from the second tank toward the first tank to empty the second tank;

control means adapted to realize opening of the first valve when emptying of the second tank is done, so as to establish a filling of identical height by communicating vessel between the first and second tanks; and calculating means adapted to determine a total volume of ink contained in the first tank and in the second tank from detection of the identical height by the level sensor and the first and second sections, the system thereby constituting a system for measuring a quantity of ink.

2. The measuring system according to claim 1, in which the means for establishing a forced hydraulic communication in ink from the second tank toward the first tank comprises a pump.

3. The measuring system according to claim 1, in which the level sensor comprises a tube arranged vertically in the second tank with one end on an outside tightly connected to a pressure sensor, pressure outside the second tank being the same as gas pressure inside the second tank, the pressure sensor thus operating relatively in relation to pressure outside the second tank.

4. The measuring system according to claim 1, further comprising:

a third tank having a third section extending over an entire height of the third tank, the third tank being connected to the first tank by a second hydraulic line and comprising a second valve with complete closing, a bottom of the third tank being in continuous hydraulic communication with the bottom of the second tank by a third hydraulic line comprising a calibrated hydraulic restrictor, the third tank also being constructed to overflow over the first tank; and means for establishing a forced hydraulic connection from the first tank toward the third tank.

5. The measuring system according to claim 4, wherein the control means is adapted to successively perform opening of the second valve during a forced hydraulic communication from the first tank toward the third tank until a constant level is established in the third tank by overflowing into the first tank and the complete closing of the second valve, when the complete emptying into the second tank is done, so as to establish filling of identical height by communicating vessel between the first, second, and third tanks, and by a flow of ink at constant pressure through the calibrated hydraulic restrictor.

6. The measuring system according to claim 4, wherein the calculating means of the measuring system is adapted to determine a volume of ink contained in the three tanks from detection of the identical height by the level sensor and of the first, second, and third sections, and to determine a viscosity of the ink, from an evolution, as a function of time, of the level measured by the level sensor when the ink flows through the calibrated hydraulic restrictor, the measuring system thus also constituting a viscometer for the ink for printing.

7. The measuring system according to claim 6, in which the calculating means is adapted to determine the viscosity of the ink from the time taken by the ink level to pass between two known heights.

8. The measuring system according to claim 6, further comprising:

a fourth tank adapted to be filled with solvent; and means for establishing a forced hydraulic communication from the fourth tank toward the second tank to bring solvent therein, wherein the calculating means is also adapted to determine a height of solvent to bring into the second tank from knowledge of a calculated viscosity, and wherein the control means of the measuring system is adapted to interrupt a supply of solvent into the second tank by forced hydraulic communication when the height is detected by the level sensor, the system thus also forming a viscosity corrector of the ink for printing.

9. The measuring system according to claim 8, in which the fourth tank is adapted to overflow into the second tank.

10. A block comprising a measuring system according to claim 9, the block comprising:

an envelope fixed between two base plates, and inside of which three tubes are arranged fastened orthogonally to a lower one of the base plates, and being arranged at a distance from an upper one of the base plates, a volume between the three tubes and the envelope being designed to constitute the first tank while each of the tubes is designed to constitute the second, third, and fourth tanks, respectively.

11. The block according to claim 10, in which the tubes have a circular section.

12. The block according to claim 10, in which the first and second valves are of a solenoid valve type and are supported by the lower base plate.

13. The block according to claim 10, in which the pump for emptying the ink from the second tank is fastened to the lower base plate.

14. The block according to claim 10, in which the pump for supplying solvent in the second tank from the fourth tank is fastened to the upper base plate.

15. The block according to claim 10, in which a pressure sensor which is part of the level sensor is supported by the upper base plate.

16. The measuring system according to claim 8, in which the means for establishing a forced hydraulic communication from the fourth tank toward the second tank to supply solvent therein comprises a pump.

17. The measuring system according to claim 1, in which each said tank has a constant section over its entire height.

18. The measuring system according to claim 1, wherein the level sensor is a continuous level sensor.

19. A fluid circuit of a continuous inkjet printer having a printing head, the fluid circuit comprising:

a measuring system according to claim 1, wherein the bottom of the first tank is connected with a drop generator of the printing head through a supply pump, and with a recovery gutter for fluids coming from the head and not used for printing through a hydro-ejector, the hydro-ejector being connected to the supply pump such that in an operating state, ink recovered in the gutter is suctioned toward the first tank.

20. The fluid circuit according to claim 19, further comprising:

a removable ink cartridge adapted to fill the first tank by forced hydraulic communication.

21. The fluid circuit according to claim 20, in which the emptying pump from the second tank toward the first tank is the pump which fills the first tank by forced hydraulic communication from the removable ink cartridge.

22. The fluid circuit according to claim 19, further comprising:

a removable solvent cartridge adapted to fill the fourth tank by forced hydraulic communication.

23. The fluid circuit according to claim 19, in which the pump supplying solvent in the second tank is the pump which supplies the drop generator with solvent in order to clean it.

24. The fluid circuit according to claim 19, in which the first tank comprises:

a vent in a top part of the first tank; and a passive condenser provided in continuous communication with the vent and comprising a cavity provided with baffles to condense solvent vapors recovered by the gutter via the hydro-ejector.

25. A measuring system in a fluid circuit of a continuous inkjet printer provided with a printing head, the system comprising:

a first tank having a first section extending over a height of the first tank and adapted to be filled with ink and to supply the printing head with pressurized ink therefrom and to recover fluids coming from the head and not used for printing;

a second tank having a second section extending over a height of the second tank and having a bottom which is hydraulically connected with a bottom of the first tank by a first hydraulic line comprising a first valve, the second tank comprising a continuous level sensor adapted to detect a height of a liquid in said second tank, a gas pressure of an inside of the first and second tanks being at a same gas pressure;

a liquid transfer subassembly configured to establish a forced hydraulic communication in ink from the second tank toward the first tank to empty the second tank; and a controller configured to realize opening of the first valve when emptying of the second tank is done, so as to establish a filling of identical height by communicating vessel between the first and second tanks, wherein said controller is further configured to determine a total volume of ink contained in the first tank and in the second tank from detection of the identical height by the level sensor and the first and second sections, the system thereby constituting a system for measuring a quantity of ink.

* * * * *